United States Patent [19]

Cassell

[11] Patent Number: 4,568,394

[45] Date of Patent: Feb. 4, 1986

[54] METHOD OF MANUFACTURING SPRINGS, INCLUDING THE PRODUCTION OF WIRE THEREFOR

[75] Inventor: Ralph M. Cassell, St. Louis, Mo.

[73] Assignee: Laclede Steel Company, St. Louis, Mo.

[21] Appl. No.: 626,970

[22] Filed: Jul. 2, 1984

[51] Int. Cl.[4] ..... C21D 8/06; C21D 1/80

[52] U.S. Cl. ..... 148/12 B; 148/12.3; 148/12.4

[58] Field of Search ..... 148/12 B, 12.3, 12.4

[56] References Cited

U.S. PATENT DOCUMENTS 4,174,981 11/1979 Cassell ..... 148/12 B
4,336,081 6/1982 Hijikata et al. ..... 148/12 B

FOREIGN PATENT DOCUMENTS 137123 8/1979 Fed. Rep. of Germany .... 148/12 B
142455 6/1980 Fed. Rep. of Germany .... 148/12 B

*Primary Examiner*—Veronica O'Keefe
*Attorney, Agent, or Firm*—Senniger, Powers, Leavitt and Roedel

[57] ABSTRACT

The method of manufacturing coiled springs comprising forming steel rod by hot rolling, oil-tempering the rod as produced in the hot rolling operation, without drawing it, by passing it through an austenitizing step, an oil quenching step and a tempering step, cold-drawing the resultant oil-tempered rod into wire, and winding springs from the wire.

12 Claims, 2 Drawing Figures

METHOD OF MANUFACTURING SPRINGS, INCLUDING THE PRODUCTION OF WIRE THEREFOR

BACKGROUND OF THE INVENTION

This invention relates to the manufacture of coiled springs, e.g., helically coiled springs or conical coiled springs, including the production of wire for making the springs.

Reference is made herein to "rod" and "wire". These terms are used in the sense of their technical meaning in the metallurgical arts, namely, "rod" means rod formed by hot rolling, which may be drawn into wire, and "wire" means wire drawn from "rod".

The invention is especially concerned with the manufacture of springs which are cold wound. Where such springs of uniform pitch are required, they have heretofore generally been made from oil-tempered steel wire, which is wire formed by drawing hot rolled steel rod through a drawing die, and oil-tempering the resultant wire. Oil-tempering is a term of art identifying a process generally involving heating the wire to austenitizing temperatures, quenching it in oil, tempering it by heating it, and recoiling it. Reference may be made to Chapter 5, entitled Oil Tempering, of the *Steel Wire Handbook* published in 1969 by The Wire Association, Inc. for a detailed description of the oil tempering of wire. In the overall process of making springs from wire such as heretofore employed, after rod has been produced by hot rolling, it is cleaned with acid, coated with lime, and pulled through a drawing die to form wire, the wire being coiled, uncoiled, then fed for oil-tempering successively through a first heating means for austenitizing it, an oil bath for quenching it, and a second heating means for tempering it, then recoiled, and ultimately wound into springs. Prior to my invention disclosed in my U.S. Pat. No. 4,174,981 of making springs from oiltempered rod (as distinguished from wire), it was regarded as essential to draw the rod into wire for forming springs because the rod could not be made within the necessary limits of tolerance insofar as its gauge and roundness are concerned (it was generally "out-of-round" beyond the relatively close tolerance required for the winding of springs with uniform pitch), and also because the rod could not be made sufficiently smooth. The present inventon returns to the manufacture of springs from wire, including the production of the wire, but with improvements over the prior techniques.

SUMMARY OF THE INVENTION

Among the several objects of this invention may be noted the provision of a method of manufacturing coiled springs, including the production of wire having mechanical properties, such as good fatigue resistance and ductility, and a relatively high ratio of elastic limit or yield to ultimate tensile strength, making it particularly suitable for use in the manufacture of the springs; and the provision of such a method which produces from carbon steel such as AISI 1060 steel spring wire which has properties substantially similar to those of oil-tempered wire made from medium-alloy steel such as AISI 9254 (chromium-silicon) steel, and which is thereby suitable for manufacture of substantially high-quality springs.

In general, the invention involves the production of wire particularly suitable for the manufacture of coiled springs comprising forming steel rod by hot rolling, oil-tempering the rod as produced in the hot rolling operation, without drawing the rod, by passing it through an austenitizing step, an oil-quenching step, and a tempering step, cold-drawing the resultant oil-tempered rod into wire, and coiling the wire.

Other objects and features will be in part apparent and in part pointed out hereinafter.

DESCRIPTION OF THE PREFERRED EMBODIMENT

Figures 1, 2:
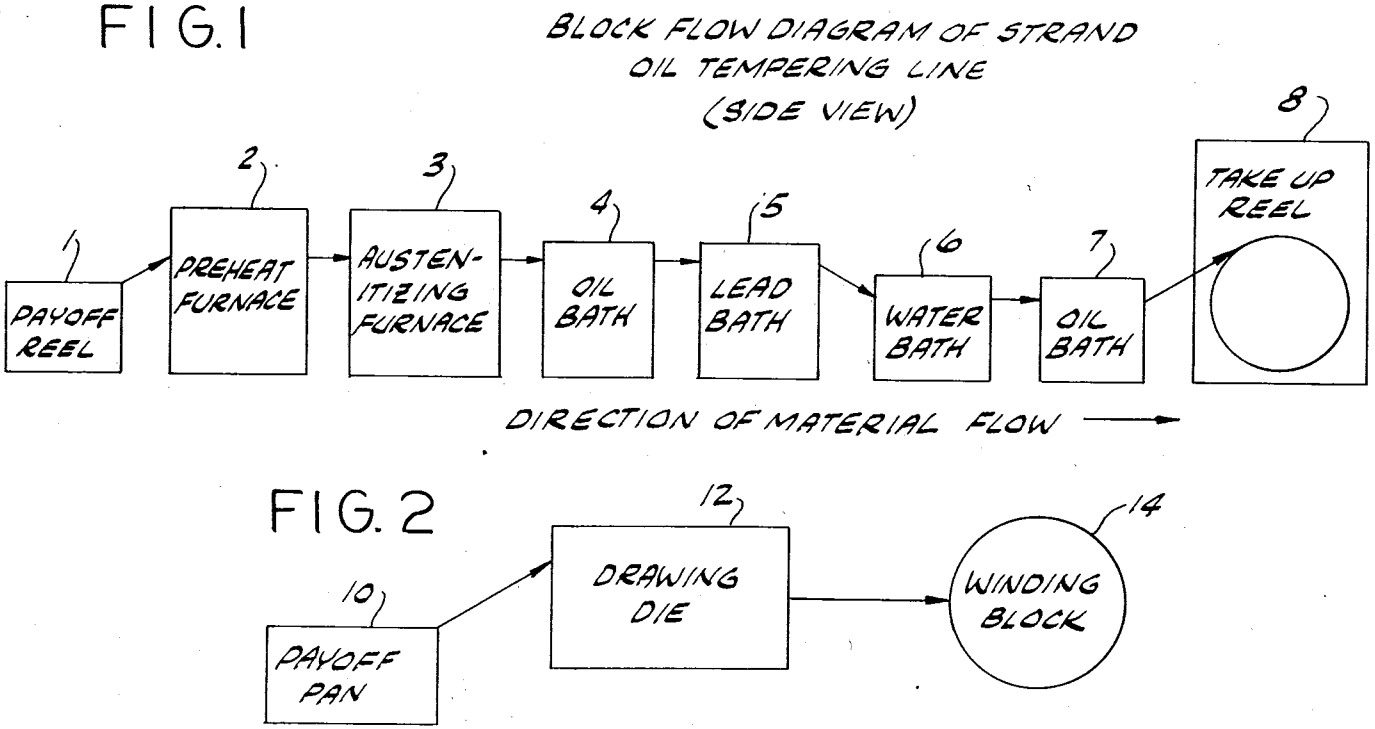
FIG. 1 is a block diagram showing the production of rod from which the wire for making springs in accordance with this invention is drawn.
FIG. 2 is a block diagram illustrating further steps of a method of the present invention.

In accordance with this invention, wire particularly suitable for the manufacture of cold wound coiled springs is produced by forming steel rod by hot rolling, oil-tempering the rod as produced in the hot rolling operation by passing it through an austenitizing step, an oil-quenching step, and a tempering step, cold-drawing the resultant oil-tempered rod into wire, and coiling the wire.

The rod may be formed by hot rolling in conventional manner, or may be formed by hot rolling in the manner disclosed in my aforesaid U.S. patent (although the close tolerances on gauge and roundness obtained with the latter are not necessary, since the rod is drawn into wire).

The rod may be hot rolled from such steels as AISI 1060 steel, AISI 1566 steel, AISI 1572, or AISI 5160 steel. In further identification thereof, these steels have the following percentages of carbon, manganese, and chrome.

| AISI Steel Grade Designation | Weight Percent Carbon | Weight Percent Manganese | Weight Percent Chrome |
|---|---|---|---|
| 1060 | 0.55/0.65 | 0.60/0.90 | N/A |
| 1566 | 0.60/0.71 | 0.85/1.15 | N/A |
| 1572 | 0.65/0.76 | 1.00/1.30 | N/A |
| 5160 | 0.56/0.64 | 0.75/1.00 | 0.70/0.90 |

Referring to FIG. 1 of the drawing, the hot rolled rod R is shown as being uncoiled from a pay-off reel at 1, fed through a preheat furnace 2, an austenitizing furnace 3, an oil quench bath 4, a molten lead tempering bath 5, a water bath 6 for cooling, and an oil bath 7 for rust protection, and then coiled up on a takeup reel at 8.

For each of the above-specified steels, the preheat temperature at 2 is about 1100° F., the austenitizing temperature at 3 is about 1650° F. to 1700° F., the quenching temperature in the oil bath at 4 is about 200° F. to 225° F., and the tempering temperature in the molten lead bath at 5 is about 800° F. to 1000° F. The equipment for the oil-tempering of the rod and the temperatures employed correspond generally to those conventionally used in the oil-tempering of wire, except that the austenitizing temperature for the rod is higher than that conventionally used in oil-tempering wire, which is 1550° F. to 1600° F.

In accordance with the process of the present invention, the coiled oil-tempered rod R is cleaned, coated with a lubricant and then cold-drawn into wire W for use as spring stock. More particularly, the coiled oiltempered rod is cleaned in a solution of permanganate, pickled in muriatic acid (hydrochloric acid), coated with lime or other suitable lubricant and placed in coil form in a pay-off pan, which is indicated at 10 in FIG. 2. With the rod cooled down to approximately room temperature, it is uncoiled from the pay-off pan 10 and pulled through a drawing die 12 for being cold-drawn into wire W, the resultant wire being wound up on a wire-winding block 14 and stripped in coil form from the block.

It has been found that the wire W cold-drawn from the oil-tempered rod R (as distinguished from wire drawn from rod and oil-tempered after it has been drawn) has unexpectedly good mechanical properties for use of the wire as spring stock. For example, as evidenced by a relatively high ratio of elastic limit or yield to ultimate tensile strength, the wire W has excellent elastic and fatigue resistance properties which compare favorably to those of wire produced in conventional manner (by drawing non-oil-tempered rod into wire and oil-tempering the wire) from more expensive medium-alloy steels, such as AISI 9254 steel containing chromium and silicon alloys. Moreover, the wire W cold-drawn from the oil-tempered rod R is quite ductile. It has also been found that if the wire W is stress-relieved by subjecting it to a temperature below the tempering temperature of the rod R (stated above to be about 800° F. to 1000° F.) for a time interval of 40 minutes, for example, the elastic and fatigue resistance properties of the wire are further enhanced without reduction in ductility. Table I compares certain mechanical properties of wire W cold-drawn from oil-tempered rod in accordance with this invention (both with and without stress-relieving) and an oil-tempered wire produced in conventional manner (by drawing non-oil-tempered rod into wire and oil-tempering the wire) from AISI 9254 (chromium-silicon) medium-alloy steel. Items 1 and 2 in the table were produced by cold-drawing a 0.406 inch diameter oil-tempered rod R made by hot rolling in conventional manner and oil-tempered in accordance with the method described above from AISI grade 1566 steel into 0.334 inch wire, the drawing process also being in accordance with the method described hereinabove. The resultant wire W was tested and then stress-relieved at 600° F. for a 40-minute time interval and tested again. Item 3 on the table is oil-tempered wire produced in conventional manner from AISI grade 9254 steel and tested (as drawn and oil-tempered). The results are shown below:

TABLE I

| Wire Type | AISI Steel Grade Designation | Wire Diameter | Elastic Limit (EL) | Ultimate Tensile Strength (TS) | EL/TS Ratio | Reduction in Area (%) | Elongation (%) |
|---|---|---|---|---|---|---|---|
| Drawn oil-tempered rod (not stress-relieved) | 1566 | 0.344 in | 216,000 | 246,000 | 0.88 | 49 | 3 |
| Drawn oil-tempered rod (stress-relieved) | 1566 | 0.344 in | 237,000 | 243,000 | 0.98 | 47 | 3 |
| Oil-tempered wire | 9251 | 0.344 in | 235,000 | 250,000 | 0.94 | 40 | 5 |

It will be apparent from the figures in the above table that oil-tempered rod R drawn into wire W of this invention exhibits a high ratio (0.88) of elastic limit to ultimate tensile strength, a clear indication of the excellent elastic and fatigue resistance properties of the wire which make it particularly suitable for use as spring material. The wire is also quite ductile, as evidenced by the reduction-in-area and elongation percentages listed in the last two columns of the table. It will also be noted that if stress-relieved, the wire W exhibits even more impressive mechanical properties, with the elastic limit/tensile strength ratio exceeding that of oil-tempered wire drawn in conventional manner from a more expensive medium-alloy steel grade AISI 9254. Moreover, the stress-relieved wire W is still quite ductile for ready workability of the wire in coiling and forming operations.

Springs, such as helically coiled compression springs, are wound from wire W cold-drawn in the manner described above from oil-tempered rod R produced as described above, the winding of the springs from the wire being carried out in the same manner as the prior winding of springs from oil-tempered wire produced in conventional manner. It will be observed that springs made in accordance with the method of the present invention, while produced from relatively inexpensive low-alloy steel, have superior spring characteristics (e.g., high elasticity and good fatigue resistance properties and ductility) which compare favorably to those of springs made in conventional manner from more expensive medium and high-alloy steels. The cost of manufacture of the springs is, therefore, reduced considerably.

In view of the above, it will be seen that several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. The method of producing steel wire (particularly suitable for the manufacture of coiled springs) comprising forming steel rod by hot rolling, oil tempering the rod as produced in the hot rolling operation, without drawing the rod, by passing it through an austenitizing step, an oil-quenching step, and a tempering step, cold-drawing the resultant oil-tempered rod into wire, and coiling the wire.

2. The method of claim 1 wherein the rod is hot rolled from AISI 1060, 1566, 1572, or 5160 steel.

3. The method of claim 2 wherein the rod is austenitized by heating it to a temperature from about 1650° F. to 1700° F., oil quenched at a temperature from about 200° F. to 225° F., and tempered at a temperature from about 800° F. to 1000° F.

4. The method of claim 1 further comprising coiling said resultant oil-tempered rod and then uncoiling it prior to drawing it into wire.

5. The method of claim 1 further comprising stress-relieving said wire at a temperature of about 600 degrees Fahrenheit.

6. The method of claim 5 wherein the wire is stress-relieved by heating it to a temperature of about 600° F. for a time interval of about 40 minutes.

7. The method of manufacturing coiled springs comprising forming steel rod by hot rolling, oil-tempering the rod as produced in the hot rolling operation, without drawing the rod, by passing it through an austenitizing step, an oil quenching step and a tempering step, cold-drawing the resultant oil-tempered rod into wire, and winding springs from the wire.

8. The method of claim 7 wherein the rod is hot rolled from AISI 1060, 1566, 1572, or 5160 steel.

9. The method of claim 8 wherein the rod is austenitized by heating it to a temperature from about 1650° F. to 1700° F., oil quenched at a temperature from about 200° F. to 225° F., and tempered at a temperature from about 800° F. to 1000° F.

10. The method of claim 7 wherein the wire is cold wound to form springs.

11. The method of claim 7 further comprising stress-relieving said wire at a temperature less than the temperature at said tempering step prior to winding springs from said wire.

12. The method of claim 11 wherein the wire is stress-relieved by heating it to a temperature of about 600° F. for a time interval of about 40 minutes.

* * * * *